US006710757B2

(12) United States Patent
Wu

(10) Patent No.: US 6,710,757 B2
(45) Date of Patent: Mar. 23, 2004

(54) METHOD OF DRIVING AN ACTIVE MATRIX ELECTRO-LUMINESCENT DISPLAY

(75) Inventor: Biing-Seng Wu, Hsinchu (TW)

(73) Assignees: Chi Mei Optoelectronics Corp. (TW); Kyocera Corporation

( * ) Notice: Subject to any disclaimer, the term of this patent is extended or adjusted under 35 U.S.C. 154(b) by 249 days.

(21) Appl. No.: 10/026,712

(22) Filed: Dec. 27, 2001

(65) Prior Publication Data

US 2002/0089474 A1 Jul. 11, 2002

(30) Foreign Application Priority Data

Jan. 8, 2001 (TW) ..... 90100392 A

(51) Int. Cl.[7] ..... G09G 3/30
(52) U.S. Cl. ..... 345/76; 315/169.3
(58) Field of Search ..... 345/76, 84, 204; 315/169.1, 169.3

(56) References Cited

U.S. PATENT DOCUMENTS 5,990,629 A * 11/1999 Yamada et al. ..... 315/169.3
6,317,107 B1 * 11/2001 Ninoyu et al. ..... 345/76

* cited by examiner

*Primary Examiner*—Regina Liang
(74) *Attorney, Agent, or Firm*—Rabin & Berdo, P.C.

(57) ABSTRACT

A method of driving an AMEL display. The AMEL display includes a pixel having a first transistor, a second transistor, a capacitor, and an organic light emitting diode (O-LED). A frame time interval for the invention includes at least a first sub-interval and a second sub-interval. The method includes the following steps. First, during the first sub-interval, apply a first pulse to the scan lines sequentially and apply corresponding data signals to the data lines. Next, during the second sub-interval, apply a second pulse to the scan lines sequentially so as to turn on the first transistors and apply a prevention signal to the data lines so as to turn off the corresponding second transistors.

6 Claims, 4 Drawing Sheets

METHOD OF DRIVING AN ACTIVE MATRIX ELECTRO-LUMINESCENT DISPLAY

This application incorporates by reference of Taiwan application Serial No. 090100392, filed on Jan. 8, 2001.

BACKGROUND OF THE INVENTION

1. Field of the Invention

The invention relates in general to a method of driving an active matrix electro-luminescent display, and more particularly to a method of driving an active matrix electro-luminescent display for preventing threshold voltage shift of thin film transistors in the active matrix electro-luminescent display.

2. Description of the Related Art

Active matrix electro-luminescent (AMEL) displays are generally used for small size displays, e.g., 1.3"×1.2", with high resolution. The AMEL displays employ organic light emitting diodes (O-LEDs) to generate optical signals. The brightness of an O-LED depends on the current flowing through itself. In addition, various types of transistors can be used as the active components to drive the O-LEDs. Among them, poly-Si thin film transistors (poly-Si TFT) are widely used. On the other hand, in thin film transistor liquid crystal displays (TFT-LCDs), amorphous Si thin film transistors (a-TFT) are widely used because of fewer masks for manufacturing, low film formation temperature, and low manufacturing cost. However, either poly-Si TFT or a-TFT has the problem that the conducting current decreases due to the threshold voltage shift after a long working time. This problem becomes serious especially while a-TFTs are used. Thus, AMEL displays rarely employ a-TFT.

Referring to FIG. 1, it shows a pixel array of O-LEDs for an AMEL display. The AMEL display has M scan lines and N data lines, forming a display of M×N pixels. A video sequence having a number of consecutive frames can be displayed in the AMEL display with the M×N pixels. Each pixel, denoted as P, has an O-LED, denoted as D, driven by thin film transistors Ta, Tb, and a capacitor C, wherein the source or drain of the transistor Ta is coupled to one of the data lines and the gate of the transistor Ta is coupled to one of the scan lines.

For example, in a pixel in FIG. 1, such as pixel P(1, 1), or P11, the gate of a transistor Ta(1, 1), or T11*a*, is connected to a scan line, Scan(1), or S1, and the source (or drain) of the transistor Ta(1, 1) is connected to a data line, Data(1), or D1, and the drain (or source) of the transistor Ta(1, 1) is connected to capacitor C(1, 1), or C11, and the gate of a transistor Tb(1, 1), or T11*b*. The drain of the transistor Tb(1, 1) is connected to an O-LED D(1, 1), or D11, while the source of the transistor Tb(1, 1) is connected to a direct current (DC) voltage source $V_{DD}$, wherein the transistor Tb(1, 1) is an N-type transistor.

Referring to FIG. 2, it illustrates waveforms for driving the circuit shown in FIG. 1. The time for the AMEL display to display a frame is defined as a frame time interval I. A conventional method for driving an AMEL display is as follows. Firstly, scan each of the scan lines sequentially. That is, apply a pulse with a positive voltage to the scan lines, Scan(1) to Scan(M), sequentially so as to turn on the transistors Ta of all of the pixels on each scan line. Simultaneously, as the transistors Ta are turned on, data signals representative of different required brightness are applied to the data lines associated with the pixels to emit light. In addition, different signal levels of the data signals correspond to the brightness for the pixels.

For example, at time $t_1$, while a pulse 202 is applied to the scan line Scan(1) so as to turn on transistors Ta(1, 1), Ta(1, 2), and Ta(1, 3), data signals with signal levels V(1, 1), V(1, 2), and V(1, 3) are applied to data lines Data(1), Data(2), and Data(3), as shown in FIG. 2. As the pulse 202 is applied to the scan line Scan(1), capacitors C(1, 1), C(1, 2), and C(1, 3) are being charged so that voltages of nodes N(1, 1), N(1, 2), and N(1, 3) approach the signal levels V(1, 1), V(1, 2), and V(1, 3) and transistors Tb(1, 1), Tb(1, 2), Tb(1, 3) are turned on. At the same time, current flows from the DC current source $V_{DD}$ through the transistors Tb(1, 1), Tb(1, 2), Tb(1, 3), O-LEDs D(1, 1), D(1, 2), and D(1, 3) so that the O-LEDs D(1, 1), D(1, 2), and D(1, 3) of the pixels P(1, 1), P(1, 2), and P(1, 3) emit light with different brightness. Since the signal levels V(1, 1), V(1, 2), and V(1, 3) are different, the current flowing through the O-LEDs D(1, 1), D(1, 2), and D(1, 3) are different. As a result, the brightness for the pixels P(1, 1), P(1, 2), and P(1, 3) are different.

At time $t_2$, although the voltage applied to the scan line Scan(1) is changed to a low level and the transistors Ta(1, 1), Ta(1, 2), and Ta(1, 3) are turned off, the capacitor C(1, 1), C(1, 2), and C(1, 3) store charges and nodes N(1, 1), N(1, 2), and N(1, 3) maintain in a high level, the transistors Tb(1, 1), Tb(1, 2), Tb(1, 3) are still in a turn-on state and the O-LEDs D(1, 1), D(1, 2), and D(1, 3) continue to emit light. Thus, at time $t_2$, the pixels P(1, 1), P(1, 2), and P(1, 3) keeps in a state for displaying. After the frame time interval I for the current frame elapses, the state of the pixels will be changed.

During a frame time interval I, threshold voltage shift may occur in the transistors Tb and would degrade the display quality. To illustrate this phenomenon, a duty ratio for a transistor is defined as a ratio of the period during which a transistor is in a turn-on state during a frame time interval to the length of the frame time interval I. For example, during the frame time interval for one frame, the pixel P(1, 1) is selected for displaying. As described above, the voltage across the capacitor C(1, 1) keeps in the high level V(1, 1) during the frame time interval and the gate of the transistor Tb(1, 1) thus remains a high level and has a current flowing through it. At the same time, the O-LED D(1, 1) emits light because of current flow through it. In this situation, the duty ratio for the transistor Tb(1, 1) is one since the transistor Tb(1, 1) remains turned on during the entire frame time interval. Unfortunately, threshold voltage shift may occur in that case. Besides, as will be explained below, the effect of threshold voltage shift occurred in the transistor Tb(1, 1) may seriously degrade the display quality.

The cause of threshold voltage shift mentioned above is described as follows. If the transistor Tb(1, 1) is an amorphous Si thin film transistor, its gate terminal is covered with an isolation layer of SiN formed at a low temperature. When the gate terminal remains in the high level state, the gate terminal will attract ions within the isolation layer of SiN and that will result in an increased voltage for the transistor Tb(1, 1) to conduct. In other words, the threshold voltage for the transistor Tb(1, 1) increases. In that case, as the capacitor C(1, 1) applies a fixed voltage to the transistor Tb(1, 1) the current flowing through the transistor Tb(1, 1) decreases, thereby reducing the brightness for the O-LED D(1, 1). The threshold voltage shift occurs in the transistor Tb with its duty ratio of one. Furthermore, the amount of brightness reduction for each pixel P is different since the voltage across the capacitor C associated with the transistor Tb of the pixel P is different. Thus, the brightness for the AMEL display may vary inconsistently and accordingly degrade the display quality. The problem due to threshold voltage shift may also occur in poly-Si TFT and degrades the display quality especially after the display is used for a long time.

SUMMARY OF THE INVENTION

It is therefore an object of the invention to provide a method of driving an active matrix electro-luminescent (AMEL) display for preventing the effect of the threshold voltage shift of thin film transistors in order to stabilize the brightness of the AMEL display and enhance the display quality.

The invention achieves the above-identified objects by providing a method of driving an AMEL display. The AMEL display includes M scan lines, N data lines, and M×N pixels, wherein the M×N pixels are capable of displaying a video signal having a plurality of consecutive frames. A frame time interval is defined as the time required for displaying one of the frames. The frame time interval has at least a first sub-interval and a second sub-interval. In addition, the pixels includes a pixel (p, q), wherein p is a positive integer not greater than M and q is a positive integer not greater than N. The pixel (p, q) includes a first transistor, a second transistor, a capacitor, and an organic light emitting diode (O-LED). The first transistor has a source/drain terminal coupled to the q-th data line and a gate terminal coupled to the p-th scan line. The second transistor is coupled to the first transistor. When a first pulse is applied to the p-th scan line, the first transistor turns on and transmits a data signal on the q-th data line to the gate of the second transistor, wherein the data signal determines the operating of the second transistor. The capacitor is coupled to the gate terminal of the second transistor. The O-LED is coupled to the source/drain terminal of the second transistor, wherein the O-LED emits light when the second transistor operates with current flowing through its source and drain. Therefore, the brightness of the O-LED corresponds to a signal level of the data signal. The method includes the steps as follows. First, during the first sub-interval, apply a first pulse to the scan lines sequentially and apply corresponding data signals to the data lines. Next, during the second sub-interval, apply a second pulse to the scan lines sequentially so as to turn on the first transistors and apply a prevention signal to the data lines so as to turn off the corresponding second transistors.

Other objects, features, and advantages of the invention will become apparent from the following detailed description of the preferred but non-limiting embodiments, The following description of the invention is made with reference to the accompanying drawings.

DETAILED DESCRIPTION OF THE INVENTION

Figure 1:
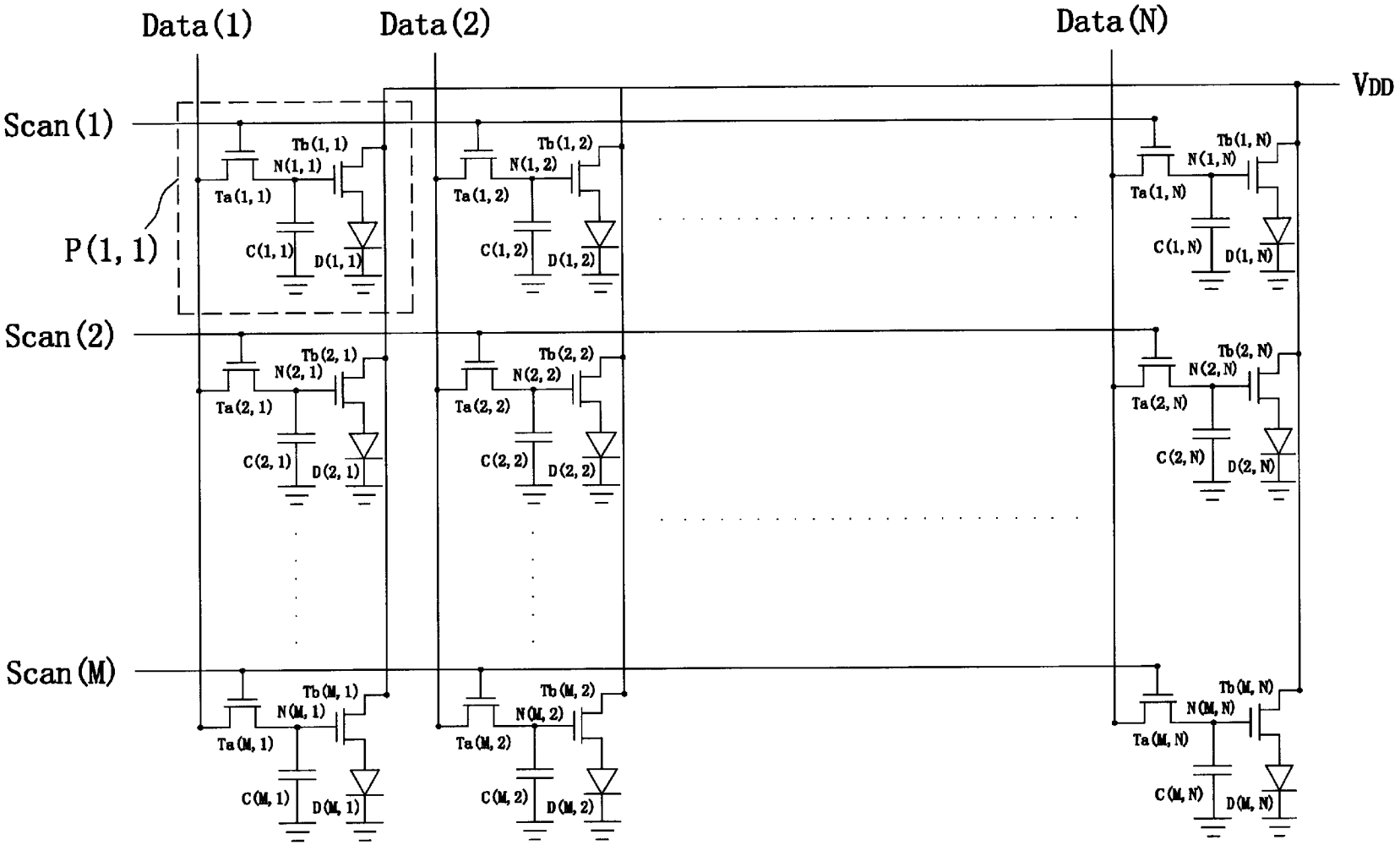
FIG. 1 (PRIOR ART)
FIG. 1 is a circuit diagram illustrating a conventional pixel array of O-LEDs for an AMEL display.
Figure 2:
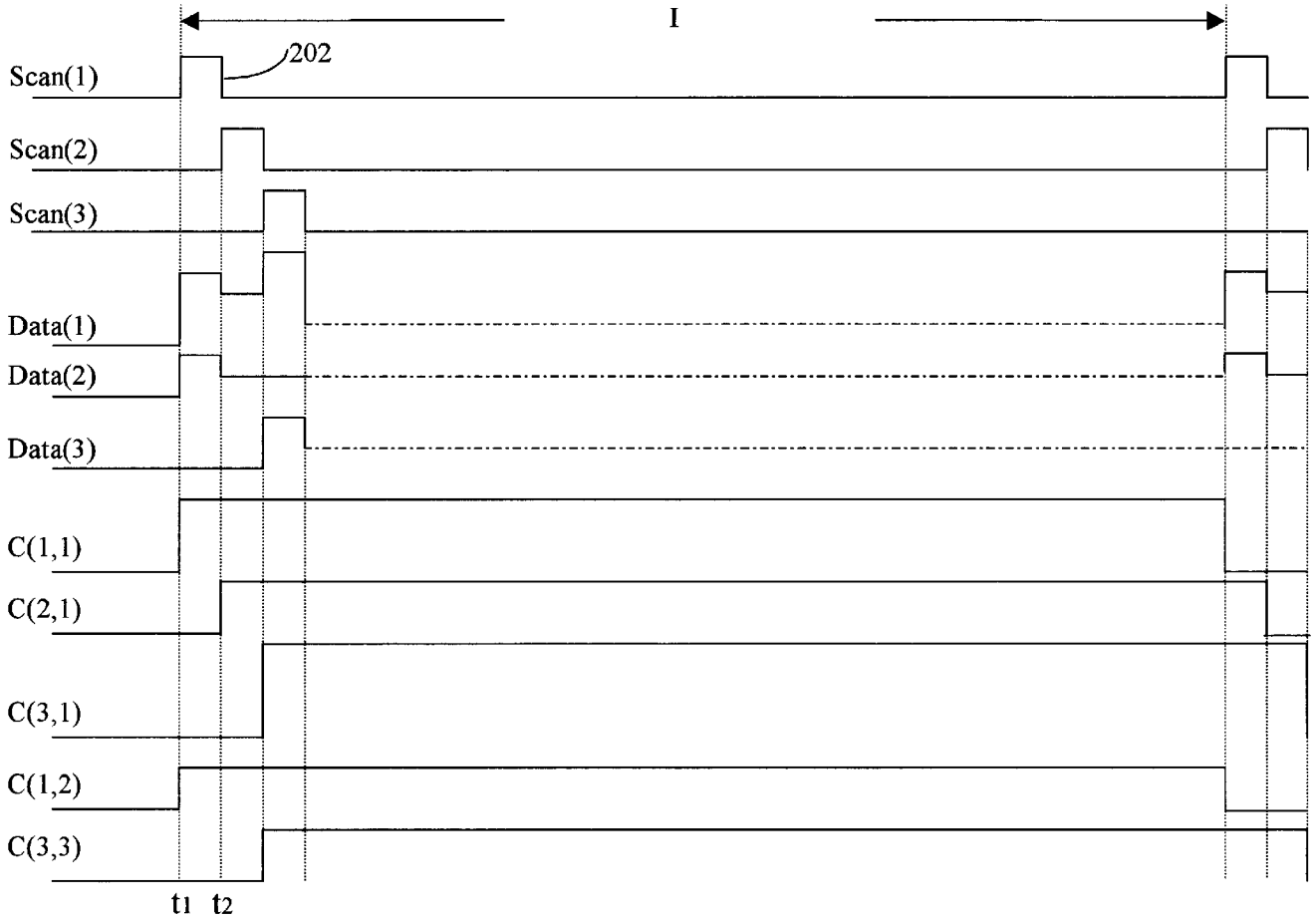
FIG. 2 (PRIOR ART)
FIG. 2 shows conventional waveforms for driving the circuit shown in FIG. 1.
Figure 3:
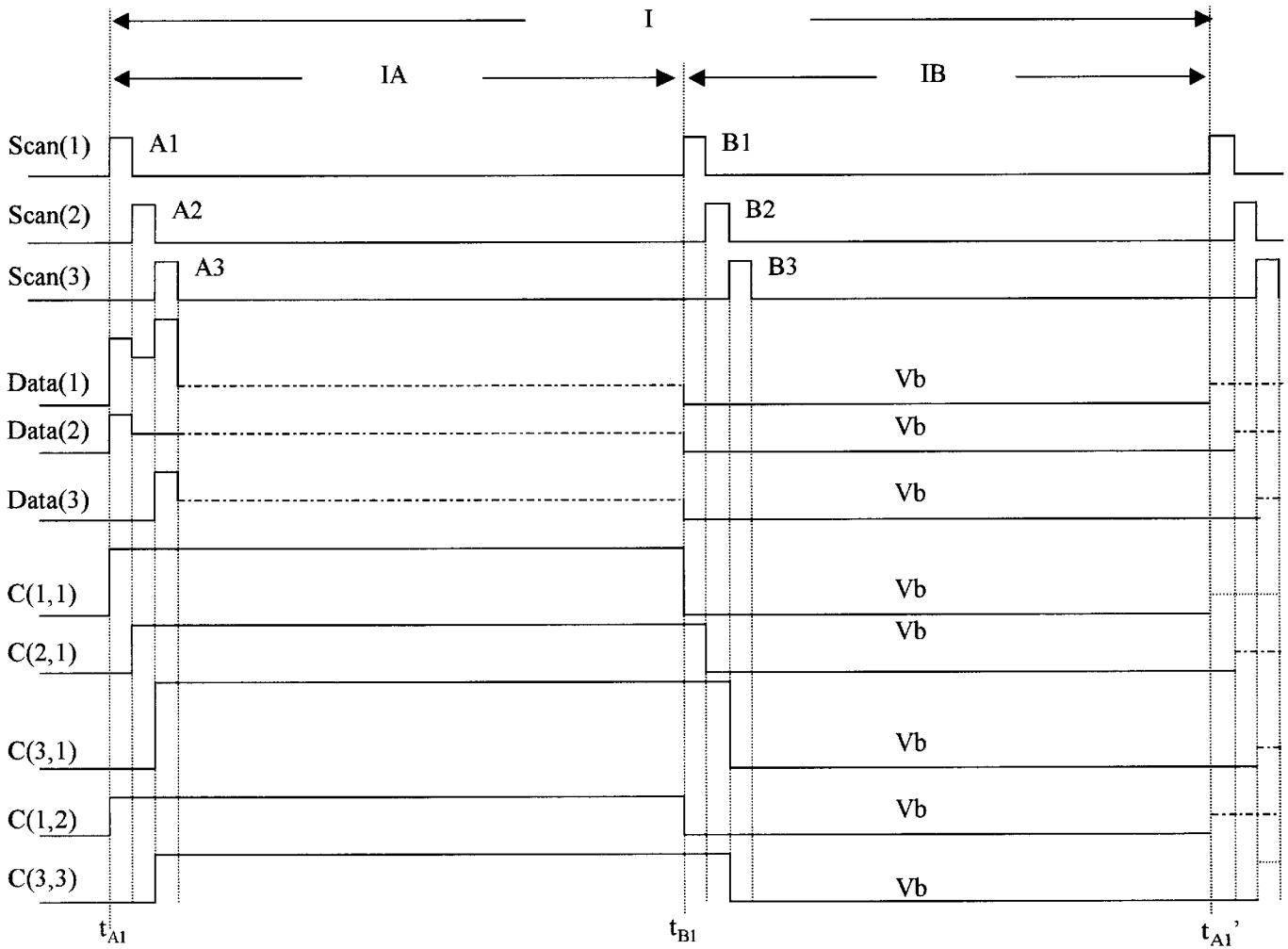
FIG. 3 shows waveforms for driving an AMEL display, according to a preferred embodiment of the invention.
Figure 4:
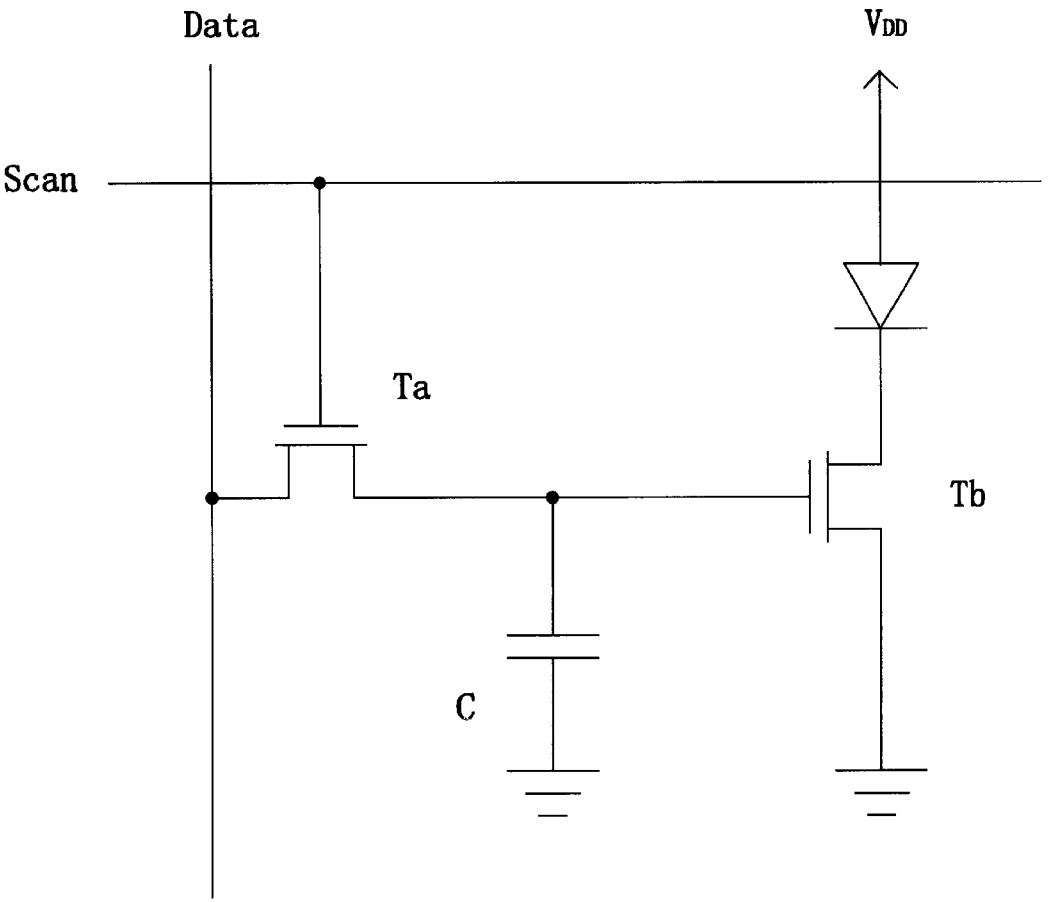
FIG. 4 is a circuit diagram illustrating a pixel formed with N-type transistor.

According to a preferred embodiment of the invention, waveforms for driving an active matrix electro-luminescent (AMEL) display is shown in FIG. 3. Referring to FIGS. 1 and 3, as compared with the conventional driving method, the driving method according to the invention has a frame time interval I which includes at least a sub-interval IA and a sub-interval IB. During the sub-interval IA, a pulse A is sequentially applied to scan lines of the AMEL display so as to turn on transistors Ta of the AMEL display sequentially while corresponding data signals are applied to data lines of the AMEL display sequentially. For a pixel of the AMEL display, the voltage across its capacitor C thus rises to a signal level approaching that of the corresponding data signal so that its transistor Tb is turned on and the organic light emitting diode (O-LED) emits light. Accordingly, the brightness of the O-LED changes in accordance with the applied data signal. During the sub-interval IB, a pulse B is sequentially applied to the scan lines of the AMEL display so as to turn on the transistors Ta sequentially while a prevention signal at a low level is applied to the data lines of the AMEL display so as to discharge each capacitor C. Each capacitor C then has its voltage drop approaching the signal level of the prevention signal and is turned off. Therefore, the duty ratio of the transistor Tb is smaller than one because the transistor Tb only operates during a portion of the frame time interval. Accordingly, the threshold voltage shift occurred in the transistor Tb can be effectively reduced.

The prevention signal described above is a low-level signal at a negative voltage while the transistors Ta and Tb are N-type thin film transistors. In another case, if P-type transistors are employed as the transistor Ta and Tb, the prevention signal is a positive voltage.

According to the invention, threshold voltage shift can be effectively reduced. For a general display requirement, a frame time interval I is 16.7 ms (i.e., the display rate is of 60 frames/sec). The pulses A and B are applied to the AMEL display within the frame time interval I. For preventing the threshold voltage shift, the pulse B is applied to the scan lines during the sub-interval IB after the pulse A is applied to the scan lines sequentially. For example, in the pixel P(1, 1) shown in FIG. 1, when a pulse B(1) is applied to the scan line Scan(1), the transistor Ta(1, 1) turns on while the prevention signal at a low level of Vb is applied to the data line Data(1). The capacitor C(1, 1) is thus discharged through the transistor Ta(1, 1) and the voltage of the node N(1, 1) drops to the signal level Vb approximately, and accordingly turns off the transistor Tb(1, 1). Since the gate terminal of the transistor Tb(1, 1) is at about the signal level Vb, the ion attracting which might occur in the interface area will be prevented and the threshold voltage of the transistor Tb(1, 1) will not vary. Therefore, the prevention of the threshold voltage shift is achieved by applying the pulse B to the scan lines sequentially and the prevention signal of the low level Vb to the data lines correspondingly.

The operating of the present invention is further described as follows. Assuming the beginning time of the sub-interval IB, time $t_{B1}$, is in the middle of the frame time interval I. That is, the sub-intervals IA and IB are of the same length of time. For example, in Scan(1), at the beginning time $t_{A1}$ of the sub-interval IA, a pulse A1 is applied to the scan line Scan(1) and the corresponding data signals are applied to the data lines Data(1) to Data(N). The transistors Tb(1, 1) to Tb(1, N) turn on, the O-LEDs D(1, 1) to D(1, N) are selectively to emit light in accordance with the corresponding data signals. At time $t_{B1}$, a pulse B1 is applied to the scan line Scan(1) and the prevention signal at the low level Vb is applied to the data lines Data(1) to Data(N) so that the transistor Tb(1, 1) to Tb(1, N) turn off and the O-LEDs D(1, 1) to D(1, N) stop emitting light. In other words, the transistors Tb(1, 1) to Tb(1, N) turn on and operate only during the interval from the times $t_{A1}$ to $t_{B1}$.

For every frame time interval I, since the transistors Tb(1, 1) to Tb(1, N) turn on and operate from the times $t_{A1}$ to $t_{B1}$ only, the duty ratio of the transistors Tb(1, 1) to Tb(1, N) is ½. Meanwhile, the O-LEDs D(1, 1) to D(1, N) selectively emit light from the times $t_{A1}$ to $t_{B1}$ only in accordance with the corresponding data signals. That is, the O-LEDs selectively emit light for one half of length of the frame time interval I. The average brightness for a specific pixel is apparently reduced as compared with that in the conventional driving method where a duty ratio of one is employed.

To improve the average brightness, the turn-on brightness of the O-LEDs needs to be increased. One approach is to increase signal levels of the data signals fed into the data lines Data(1) to Data(N) so as to increase the turn-on brightness for the O-LEDs. By using this approach, the average brightness of the pixels driven according to the invention can approach that driven according to the conventional approach.

In addition, the duty ratio of the transistors Tb is adjustable. The duty ratio is the ratio of the lengths of the sub-intervals IA to the entire frame time interval I. That is, the duty ratio of the transistor Tb of a pixel can be adjusted by adjusting the length of the sub-intervals IA and IB for the pixel.

Another approach to adjust the average brightness of each pixel of the AMEL display is to change the duty ratio of the transistor Tb of the pixel. The average brightness of a pixel is determined by multiplying the brightness of the pixel with the length of sub-interval IA and then dividing by the length of the frame time interval I. The adjustment to the average brightness of the AMEL display panel is made by adjusting the interval between the pulses A and B; i.e., by adjusting the duty ratio for the transistors Tb. Besides, the width of the pulse B can be determined according to the discharge time for the capacitor C of the pixels.

As disclosed above, the method of driving an AMEL display can effectively prevent the effect of the threshold voltage shift of thin film transistors, thereby stabilizing the brightness and enhancing the display quality. In the above embodiment, N-type transistors are employed as the transistor Tb for illustration. However, it should be noted that the use of N-type transistors gives no limitation to the invention. When P-type transistors Tb are employed, as shown in FIG. 3, the P-type transistor Tb has its source terminal grounded and drain terminal connected to the direct current (DC) voltage source $V_{DD}$ via the O-LED. The method for AMEL display driving according to the invention is applicable to AMEL displays employing P-type transistors.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method of driving an active matrix electroluminescent (AMEL) display, wherein the AMEL display comprises M scan lines, N data lines, and M×N pixels, the M×N pixels are capable of displaying a video signal comprising a plurality of consecutive frames, a frame time interval is required for displaying one frame, the frame time interval comprises at least a first sub-interval and a second sub-interval, and the M×N pixels comprise a pixel (p, q), wherein p is a positive integer not greater than M and q is a positive integer not greater than N, and the pixel (p, q) comprises:

a first transistor, having a source/drain terminal coupled to the q-th data line and a gate terminal coupled to the p-th scan line;

a second transistor, coupled to the first transistor, wherein when a first pulse is applied to the p-th scan line, the first transistor turns on and transmits a data signal on the q-th data line to the gate of the second transistor, wherein the data signal determines the operating of the second transistor;

a capacitor coupled to the gate terminal of the second transistor;

an organic light emitting diode (O-LED), coupled to the source/drain terminal of the second transistor, wherein the O-LED emits light when the second transistor operates, and the brightness of the O-LED corresponds to a signal level of the data signal;

the method comprising:

during the first sub-interval, applying a first pulse to the scan lines sequentially and applying corresponding data signals to the data lines; and during the second sub-interval, applying a second pulse to the scan lines sequentially so as to turn on the first transistors and applying a prevention signal to the data lines so as to turn off the corresponding second transistors.

2. The method of claim 1, wherein the first transistor is a thin film transistor.

3. The method of claim 1, wherein the second transistor is a thin film transistor.

4. The method of claim 1, wherein the second transistor is an N-type transistor.

5. The method of claim 1, wherein the second transistor is a P-type transistor.

6. The method of claim 1, wherein the prevention signal has a fixed signal level.

* * * * *